US005495325A

United States Patent [19]

Nagahara

[11] Patent Number: 5,495,325

[45] Date of Patent: Feb. 27, 1996

[54] IMAGE FORMING METHOD AND IMAGE FORMING APPARATUS

[75] Inventor: Akira Nagahara, Kawasaki, Japan

[73] Assignee: Fujitsu Limited, Kawasaki, Japan

[21] Appl. No.: 117,934

[22] Filed: Sep. 7, 1993

[30] Foreign Application Priority Data

Dec. 22, 1992 [JP] Japan ..... 4-356750

[51] Int. Cl.[6] ..... G03G 21/00

[52] U.S. Cl. ..... 355/298; 355/246

[58] Field of Search ..... 355/296, 297, 355/298, 299, 300, 245, 246, 208; 15/256.51; 118/652, 699; 430/125

[56] References Cited

U.S. PATENT DOCUMENTS

| | | | |
|---|---|---|---|
| 4,449,241 | 5/1984 | Nakayama | 118/699 |
| 4,640,608 | 2/1987 | Higaya et al. | 15/256.51 X |
| 4,659,212 | 4/1987 | Ichihara et al. | 15/256.51 X |
| 5,073,800 | 12/1991 | Yamaguchi et al. | 355/297 |
| 5,111,251 | 5/1992 | Uno et al. | 355/297 |
| 5,173,735 | 12/1992 | Kusumoto | 355/271 |
| 5,200,789 | 4/1993 | Oshiumi | 355/296 |

*Primary Examiner*—A. T. Grimley
*Assistant Examiner*—Thu Anh Dang
*Attorney, Agent, or Firm*—Armstrong, Westerman, Hattori, McLeland & Naughton

[57] ABSTRACT

Disclosed are an image forming method that removes adhered material from a latent image carrier and then forms an image on the latent image carrier, and an image forming apparatus that employs this method. The image forming apparatus includes: a developing unit for developing the latent image on the image carrier by toner and for collecting residual toner on the carrier; a transfer unit for transferring to the developed image a sheet; a removing mechanism for removing material that adheres to the carrier; a drive mechanism for rotating the carrier; and a controller for selectively executing an image forming mode, to control the individual constituent units, and an adhered material removal mode, to permit the removing mechanism to remove the material that adheres to the carrier as it is rotated by the drive mechanism. The image forming method includes: a rotation start step, for initiating rotation of an endless latent image carrier; an adhered material removal step, for permitting an removing mechanism to remove material that adheres to the carrier during at least one rotation of the carrier following the initiation of the rotation; a charging step, for applying an electrical charge to the carrier; a latent image forming step, for forming a latent image on the carrier; a developing step, for developing the latent image on the carrier and for collecting residual toner from the carrier; and a transfer step, for transferring to a sheet a toner image on the carrier.

24 Claims, 7 Drawing Sheets

IMAGE FORMING METHOD AND IMAGE FORMING APPARATUS

BACKGROUND OF THE INVENTION

1. Field of the Invention

The present invention relates to an image forming method that forms an image on a sheet and an image forming apparatus that employs that method. In particular, the present invention .pertains to an image forming method that assigns to a developing unit the collection of residual toner from a latent image carrier, and thus eliminates the need for a cleaner, and an image forming apparatus that employs that method.

2. Description of the Related Art

To satisfy the demand for plain paper image recording, latent image forming apparatuses, such as electrophotographic apparatuses, are employed for such image forming apparatuses as copy machines, printers, and facsimile machines. In such an image forming apparatus, electrostatic latent images are formed on a photosensitive drum, and are developed by using toner particles to visualize the images. After the toner images are transferred to a sheet of paper, the sheet is separated from the photosensitive drum and the toner images on the sheet are fixed. As the process by which the toner images are transferred to the sheet is not 100% effective, and thus some toner particles adhere thereafter to the photosensitive drum, a cleaner, such as a cleaning brush or a cleaning blade, is provided for the removal and collection of the residual toner that adheres to the surface of the photosensitive drum.

Since the collected toner is not used for printing, and the cleaning process does not contribute to the economical operation of the apparatus; as a cleaner is large enough to retain a predetermined volume of accumulated toner, and an image forming apparatus that incorporates such a cleaner cannot be compactly constructed; and also because, in consonance with the recent general concern for the prevention of environmental pollution, the disposal of as little waste toner as possible is preferred, a desirable image forming process is one that does not require the employment of a cleaner, FIGS. 1 and 2 are diagrams for explaining the prior art. FIG. 1 illustrates an electrophotographic printer that includes a cleaner. As shown in FIG. 1, positioned around the periphery of a photosensitive drum 10, which may be an organic photosensitive body, a Se photosensitive body or an a-Si photosensitive body, are a corona charger 11, which uniformly electrifies the photosensitive drum 10; a laser optical system 12, for image exposing; a developing unit 13, such as a two-component developing unit, a magnetic, one-component developing unit or a non-magnetic, one-component developing unit; a corona discharger 14, which electrostatically transfers a toner image to a sheet of paper P; a cleaner 15, such as a cleaning brush or a cleaning blade; and a deelectrification lamp 16. Further, a fixing unit 17, which employs heat and pressure to fix a toner image to a sheet P, is positioned along a feeding path for the sheet P.

In the image forming process, the corona charger 11 uniformly electrifies the surface of the photosensitive drum 10, and the laser optical system 12 exposes the photosensitive drum 10 to light and forms electrostatic latent images on its surface. Charged toner is then supplied by the developing unit 13 to develop the electrostatic latent images on the photosensitive drum 10.

The corona discharger 14, which is a transfer unit, is so positioned relative to the photosensitive drum 10 that the sheet P passes between them. The corona discharger 14 applies to the fed sheet P a charge having the opposite polarity of the charge carried by the toner, and electrostatic attraction transfers the toner images from the photosensitive drum 10 to the sheet P. While the sheet P is passing through the fixing unit 17, heat and pressure fix the toner image to the sheet P. The printing process is thereafter terminated.

Then, the toner particles that did not migrate from the photosensitive drum 10 to the sheet P when the toner image was transferred are removed by the cleaner 15, and the photosensitive drum 10 is deelectrified by the deelectrification lamp 16 and returned to its initial, uncharged state. The above printing process is then repeated.

The residual toner, which is collected from the photosensitive drum 10 by the cleaner 15, is temporarily stored in a toner disposal tank by a toner transfer mechanism (not shown). When a predetermined volume of toner has accumulated in the toner disposal tank, it is removed from the apparatus by a user.

The above described image forming process has the following shortcomings:

(1) Compact construction of an apparatus is not possible because a mechanism for accumulating collected toner is required;

(2) Space is required for a colleced toner storage container;

(3) The residual toner accumulated during the printing process is not reused and does not contribute to economical operation;

(4) Toner disposal adversely affects the environment; and (5) The service life of the photosensitive drum 10 is shortened by the scrubbing action that is performed by a cleaner to remove toner from its surface.

To resolve such shortcomings, a cleaner-less image forming process in which the cleaner 15 is not required is proposed in "A Cleaner-less Laser Printer Employing A Non-magnetic, One-component Developing System," The Electrophotographic Society Magazine of Japan, Vol. 30, Issue 3, pp. 293–301, and in other references. In the proposed image forming process, residual toner is collected by the developing unit 13 and is reused for printing.

FIG. 2 is a diagram illustrating the arrangement of a conventional image forming apparatus that does not have a cleaner. The same reference numbers as are used to denote the components in FIG. 1 are employed to denote corresponding components in FIG. 2. The arrangement of the image forming apparatus in FIG. 2 is different from that in FIG. 1 only in that the cleaner 15 has been removed and a conductive diffusing brush 18 has been added. In the image forming process, residual toner particles on the photosensitive drum 10 are scattered thereon by the diffusing brush 18. The corona charger 11 then uniformly charges the photosensitive drum 10, with the diffused toner adhering thereto, the laser optical system 12 performs image exposure, and the developing unit 13 collects the toner residue while concurrently developing the image.

Since the toner Concentrated on parts of the photosensitive drum 10 is scattered by the diffusing brush 18, the concentration of toner per unit area is reduced and toner collection by the developing unit 13 is facilitated. Further, the residual toner is thus prevented from acting as a filter for the charged ions from the corona charger 11, or as a filter during image exposure.

The main feature of the image forming process is that the toner deposited on the photosensitive drum 10 is collected while a developing procedure is performed. An explanation of this will now be given that involves the photosensitive drum 10 and toner, both of which are negatively charged. The potential at the surface of the photosensitive drum 10 is set to from −500 to −1000 V by the charger 11. When image exposure is performed, the potential in the illuminated areas of the photosensitive drum 10 is reduced, to within a range of from zero to a negative potential of several tens of volts, and these illuminated areas collectively delineate electrostatic latent images on the surface of the photosensitive drum 10. In the developing process, a development bias voltage, which is almost an average of the surface potential and the latent image potential (for example, −300 V), is applied to a developing roller of the developing unit 13. During the actual developing, an;electric field, which is formed by the development bias voltage and the latent image potentials, causes the negatively charged toner on the developing roller to migrate to the electrostatic latent images on the photosensitive drum 10, and develops thereon a toner described image.

In a cleaner-less process, concurrent with the developing procedure, an electric field that is formed by the surface potential and the development bias voltage attracts to the developing roller the residual toner that has been dispersed along the surface of the photosensitive drum 10 during the diffusion process.

When the apparatus is halted, the residual toner particles and paper fragments that adhere to the photosensitive drum 10, ozone generated by the corona discharge at the charger 11, and nitrogen in the air chemically bond and produce chemical compounds. These compounds are deposited on the photosensitive drum 10. More specifically, sulfur (S), potassium (K), and sodium (Na) components of the toner and paper fragments chemically bond with ozone and nitrogen, and chemical compounds, such as NANO3 and KNO3, are thereby produced and are deposited on the photosensitive drum 10.

While the apparatus is operating and the photosensitive drum 10 is rotating, the chemical bonding that produces these chemical compounds does not occur because air is circulating throughout the interior of the apparatus and the humidity level therein is low. Once the apparatus is halted (the rotation of the photosensitive drum 10 is stopped), however, such compounds are produced. Since such chemical compounds have a low resistance value, those chemical compounds that adhere to the photosensitive drum 10 when the apparatus is reactivated will not hold an electric charge. Thus, as the areas that they occupy will not accept print images and as information cannot therefore be written to those areas of the photosensitive drum 10 to which they adhere, non-printing portions occur on the photosensitive drum 10 in the areas occupied by the compounds.

As described above, in a conventional cleaner-less process, since the force with which the diffusing brush 18 contacts the photosensitive drum 10 is sufficient only to disperse the residual toner particles and not to furbish the surface of the photosensitive drum 10, the adhering chemical compounds are not removed. As a result, this process is ineffective for preventing the occurrence of non-printing portions.

SUMMARY OF THE INVENTION

It is an object of the present invention to provide an image forming method and an image forming apparatus that can prevent the occurrence of non-printing portions on a latent image carrier due to deposited chemical compounds in a cleaner-less process.

It is another object of the present invention to provide an image forming method and an image forming apparatus that can remove unwanted chemical compounds in a cleaner-less process.

It is still another object of the present invention to provide an image forming method and an image forming apparatus that can employ a simply structured device to remove chemical compounds in a cleaner-less process.

To achieve these objects, according to one aspect of the present invention, an image forming apparatus comprises: an endless latent image carrier; a charging unit for charging the latent image carrier; a latent image forming unit for forming a latent image on the latent image carrier; a developing unit for developing a latent image on the latent image carrier by toner and for collecting residual toner on the latent image carrier; a transfer unit for transferring to a sheet of paper a toner image on the latent image carrier; an adhered material removing mechanism for removing material that adheres to the latent image carrier; a drive mechanism for rotating the latent image carrier; and a controller for selectively executing an image forming mode, to control the individual constituent units, and an adhered material removal mode, to permit the adhered material removing mechanism to remove the material that adheres to the latent image carrier as it is rotated by the drive mechanism.

According to another aspect of the present invention, an image forming method comprises: a rotation start step, for initiating rotation of an endless latent image carrier; an adhered material removal step, for permitting an adhered material removing mechanism to remove material that adheres to the latent image carrier during at least one rotation of the latent image carrier following the initiation of the rotation; a charging step, for applying an electrical charge to the latent image carrier; a latent image forming step, for forming a latent image on the latent image carrier; a developing step, for developing the latent image on the latent image carrier by toner and for collecting residual toner from the latent image carrier; and a transfer step, for transferring to a sheet of paper a toner image on the latent image carrier.

According to the present invention, since the previously described chemical compounds are produced when the apparatus is halted, when the latent image carrier is rotated after the apparatus has been reactivated, the chemical compounds are removed from the latent image carrier by the adhered material removing mechanism. Further, as the adhered material removing mechanism contacts the latent image carrier only at the initiation of the rotation of the latent image carrier, during the removal of the generated chemical compounds not much scrubbing of the latent image carrier is performed. The cleaner-less process is thus executed.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principle of the invention.

DETAILED DESCRIPTION OF THE PREFERRED EMBODIMENT

Figure 1:
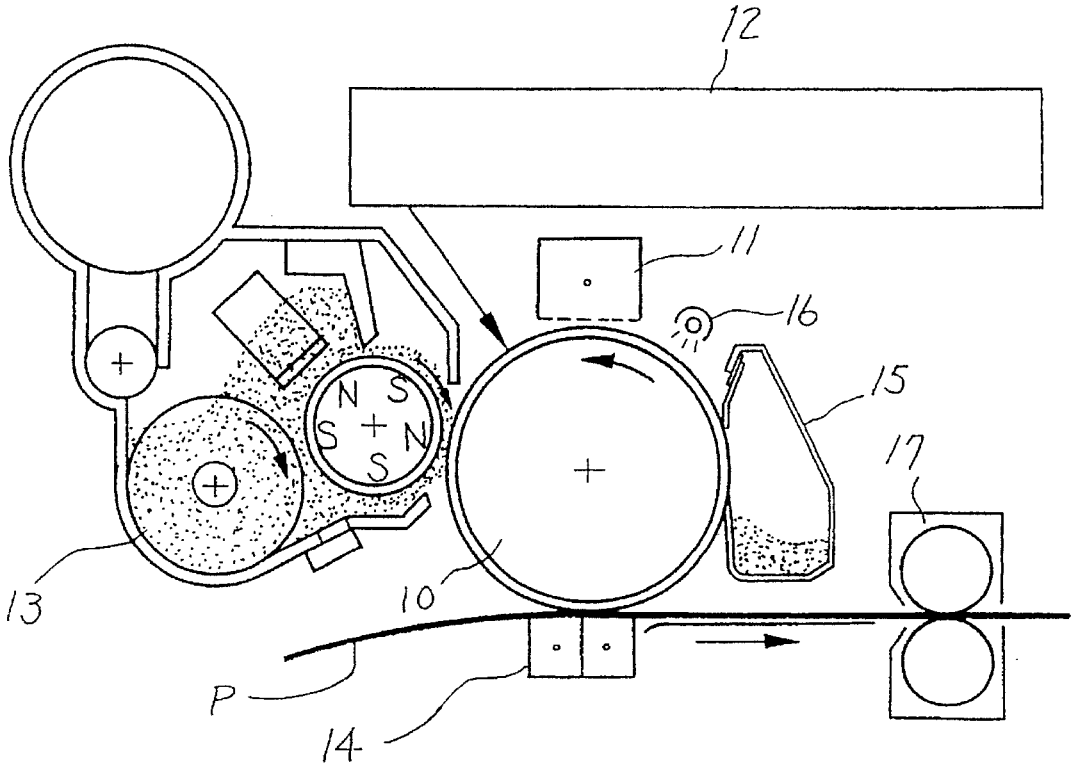
FIG. 1 PRIOR ART
FIG. 1 is an explanatory diagram illustrating a conventional image forming apparatus that includes a cleaner.
Figure 2:
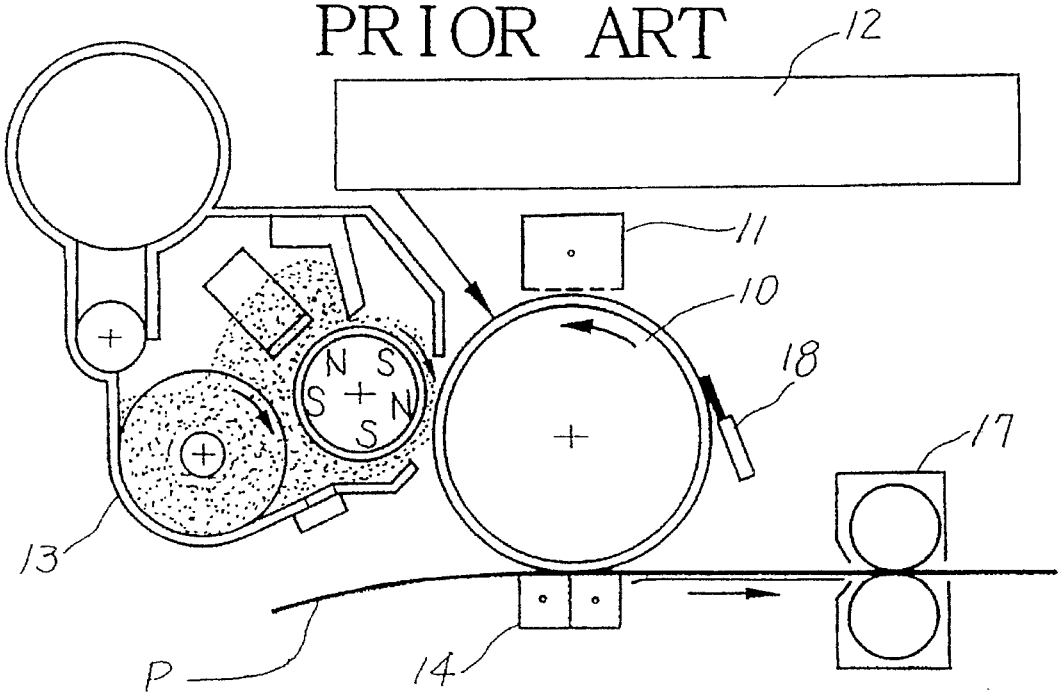
FIG. 2 PRIOR ART
FIG. 2 is an explanatory diagram illustrating a conventional image forming apparatus that does not include a cleaner.
Figure 3:
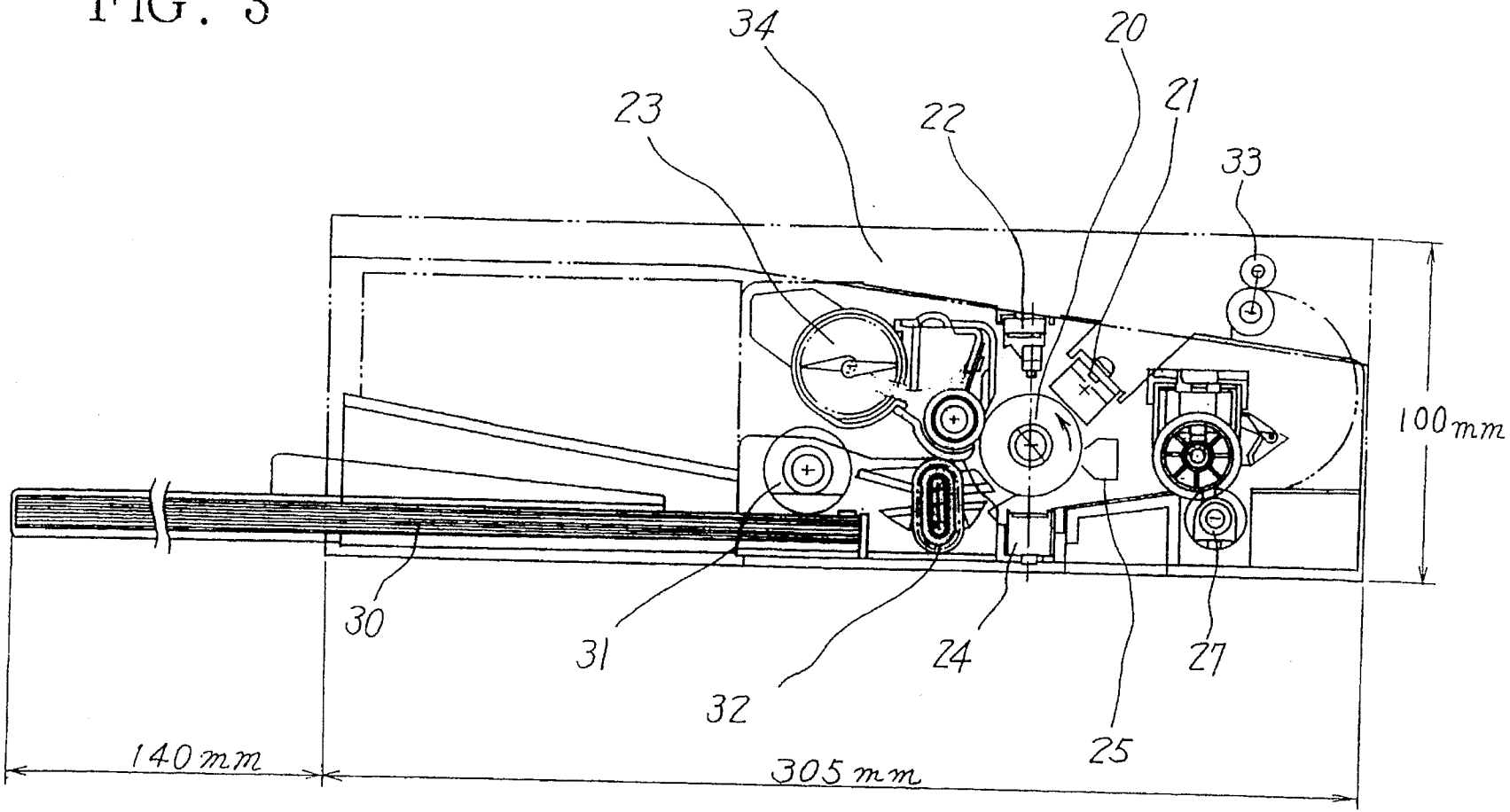
FIG. 3 is a diagram showing the arrangement of an image forming apparatus according to one embodiment of the present invention.
Figure 4:
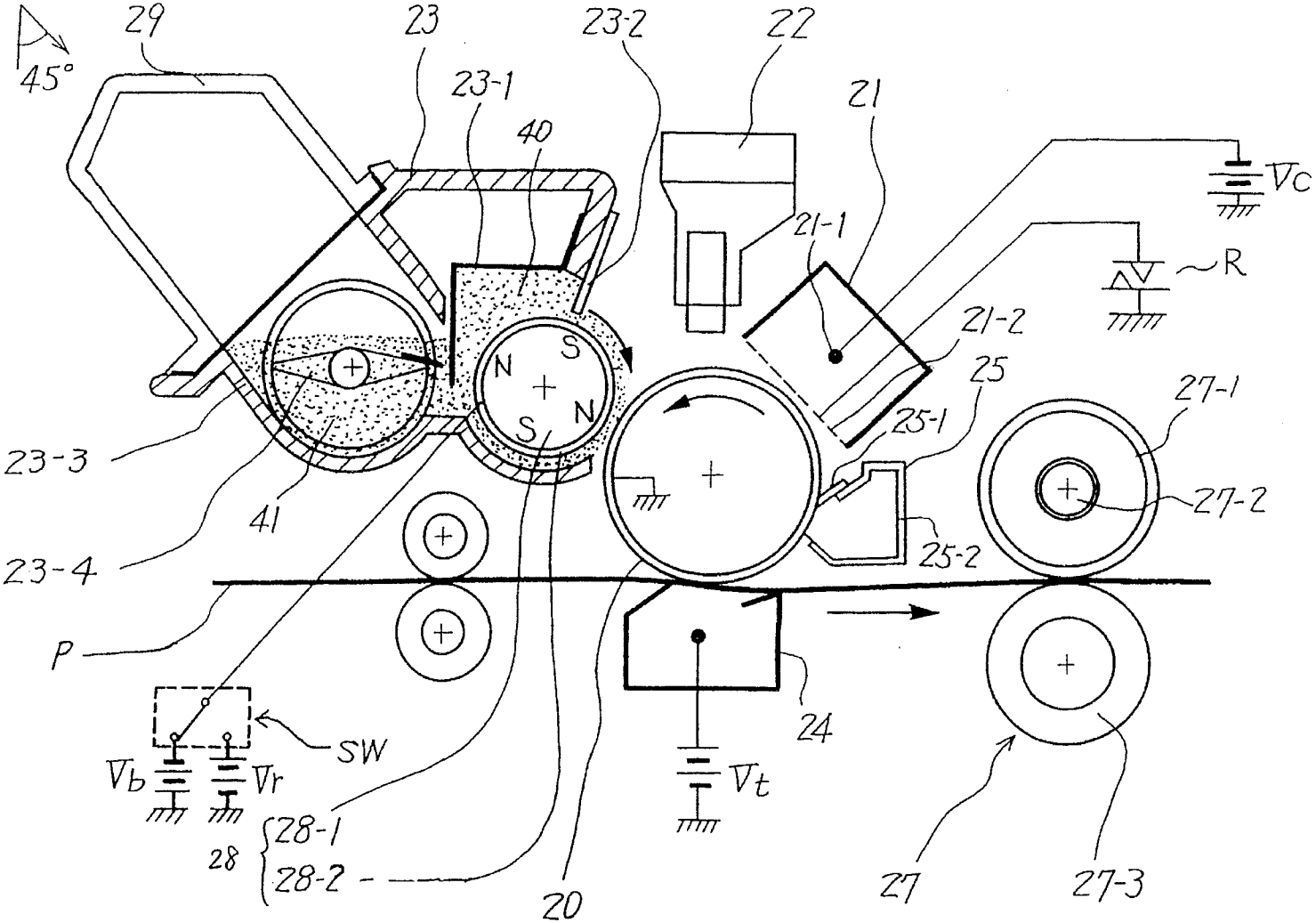
FIG. 4 is an enlarged diagram of a portion of the image forming mechanism in FIG. 3.

FIG. 3 is a diagram illustrating the general arrangement of an image forming apparatus according to an embodiment of the present invention; FIG. 4 is an enlarged diagram of a portion of the image forming mechanism in FIG. 3. An electrophotographic printer is employed as an image forming apparatus in this embodiment.

In FIGS. 3 and 4, a photosensitive drum 20 is an aluminum drum that is coated to a thickness of about 26 microns with a separated-function organic photosensitive material. The photosensitive drum 20, which has an external diameter of 24 mm, is rotated counterclockwise, as is indicated by an arrow in FIG. 4, at a peripheral velocity of 24 mm/s. A primary charger 21, which includes a scorotron, uniformly charges the surface of the photosensitive drum 20. A voltage of −3 to −8 kV is applied to a corona wire 21-1 of the primary charger 21 by a high voltage power supply VC. To ensure that a uniform potential is applied to the surface of the photosensitive drum 20, a varistor R is positioned between a mesh 21-2, provided in a scorotron opening, and the drum ground. Instead of varistor R, a power supply that produces a voltage that corresponds to a predetermined surface potential for the photosensitive drum 20 may be connected to the mesh 21-2. In this embodiment, the surface potential of the photosensitive drum 20 is set at −650 V.

An optical unit 22, exposes the uniformly charged photosensitive drum 20 to light to form electrostatic latent images. The optical unit 22 is an integrated LED optical system comprising an LED array and a CELLPHOC array. As the optical unit 22 generates light image according to applied image pattern signals and exposes them to the photosensitive drum 20, electrostatic latent images that carry charges of from −50 to −100 V, are formed on the photosensitive drum 20.

A developing unit 23 supplies charged toner to electrostatic latent images on the photosensitive drum 20 to visualize the image. The developing unit 23 includes a developing roller 28 that is formed of a metal sleeve 28-2 and a magnet 28-1, which has a plurality of magnetic poles, that is fitted inside;the sleeve 28-2. As the magnet 28-1 inside the sleeve 28-2 is fixed, rotation of the sleeve 28-2 feeds a magnetic developer, which will be described later. Power supplies Vb and Vr are connected to the sleeve 28-2 by a switch SW. By manipulation of the switch SW, it is possible to select either a development bias voltage Vb, the normal selection, or a reverse bias voltage Vr for activation.

A developing chamber 23-1 is defined around the developing roller 28. The developing chamber 23-1, which has a constant capacity, is filled with a two-component developer 40, a mixture that is composed of a magnetic carrier and a magnetic toner. Since the volume of the magnetic carrier held in the developing chamber 23-1 is constant, the volume of the magnetic toner held in the developing chamber 23-1 is also constant. Therefore, by supplementing the toner with an amount that is equivalent to that which has been consumed, toner density can be constantly maintained and a special toner density adjusting mechanism can be eliminated. In other words, when the developing chamber 23-1 is filled with magnetic carrier, whose volume corresponds to the control point for toner density, toner density is automatically adjusted within a predetermined range.

For the carrier, the developer 40 employs a magnetite carrier that has an average particle diameter of 70 microns, and for the toner, employs a magnetic toner that has an average particle diameter of seven microns and that is produced by polymerization. Since the polymerized toner particles have uniform diameters, and the particles disperse evenly, during a transfer procedure that will be described later, uniform adhesion of the toner particles in an image transferred from the photosensitive drum 20 to a sheet is possible. Accordingly, when polymerized toner particles are used, the electric field in the transfer section is more uniform and transfer efficiency is higher than when the conventional pulverized toner is used. For example, the transfer efficiency for pulverized toner ranges from 60 to 90%, while the higher transfer efficiency for polymerized toner is 90% or greater. The appropriate density of polymerized toner is 5 to 60 wt. %; in this embodiment it is 15±5 wt. %.

A doctor blade 23-2 adjusts the amount of developer, which the developing roller 28 supplies to the photosensitive drum 20, so that the quantity available for developing electrostatic latent images on the photosensitive drum 20 is neither excessive nor insufficient. To regulate the supply and availability of the developer, there is a gap between the edge of the doctor blade 23-2 and the surface of the developing roller 28 that is normally adjusted to provide an opening of approximately 0.1 to 1.0 mm.

A toner retainer 23-3 contains only magnetic toner. Included within the toner retainer 23-3 is an agitator 23-4 that when rotated supplies toner to the developing chamber 23-1.

The toner is then mixed with the magnetic carrier in the developing chamber 23-1 by the friction that arises from the magnetic attraction of the magnetic carrier to the developing roller 28, the developing feeding force of the sleeve 28-2, and the developer regulating pressure exerted by the doctor blade 23-2. By this, the toner is charged with a specified magnetic polarity and the predetermined volume. In this embodiment, a series of charges between the toner and the carrier is employed to negatively charge the toner.

A replaceable toner cartridge 29 is filled with toner 41 and is attached to the developing unit 23. The toner cartridge 29, which is replaced when its supply of toner is exhausted, supplies supplemental toner 41 to the toner retainer 23-3.

A transfer unit 24, which includes a corona discharger, electrostatically transfers to a sheet P a toner image from the photosensitive drum 20. A voltage of ∓to +10 kV is applied to the corona wire of the transfer unit 24, by the power supply Vt, and electric charges are produced by corona discharge. The transfer unit 24 employs the produced charges to electrify the reverse surface of the sheet P, and transfers the toner image from the photosensitive drum 20 to the sheet P. The desired power supply Vt is a constant-current supply that supplies a constant charge to a sheet to prevent the environmental deterioration of transfer efficiency.

A scraping unit 25, an adhered material removing mechanism, includes a rubber blade 25-1 and a chamber 25-2 for retaining a removed, adhered material, as is shown in FIG. 4. The scraping unit 25 removes adhered chemical material from the photosensitive drum 20, as will be described later while referring to FIG. 5.

A fixing unit 27 is constituted by a heat roller 27, within which is mounted a halogen lamp 27-2 as a heat source, and a pressure roller (backup roller) 27-3. The fixing unit 27 heats the sheet P and then fixes the toner image to the sheet P.

A sheet cassette 30, which holds a supply of paper sheets, is detachable from the apparatus. A pick roller 31 extracts sheets from the sheet cassette 30. When an extracted sheet abuts upon a resist roller 32, the resist roller 32 first aligns the leading edge of the sheet and then feeds the sheet to the transfer unit 24. A discharge roller pair 33 discharges an image-fixed sheet to a stacker 34. The stacker 34 is provided along the upper surface of the apparatus, and discharged sheets are stacked thereon.

The image forming process of the printer will now be explained. After the surface of the photosensitive drum 20 has been uniformly charged to −650 V by the scorotron charger 21, image exposure is performed by the LED optical system 22, thereby electrostatic latent images that carry charges of from −50 to −100 V are formed on the photosensitive drum 20 within a background portion that carries a charge of −650 V. When the switch SW is closed, a development bias voltage (−400 V) from the power supply Vb is applied to the sleeve 28-2 of the developing roller 28 in the developing unit 23. Thereafter, the developing unit 23 supplies polymerized toner, which has been negatively charged by mixing it width the magnetic carrier, to develop the electrostatic latent images on the photosensitive drum 20 and thus visualize toner images. When a sheet P in the sheet cassette 30 is extracted by the pick roller 31, the resist roller 32 aligns the leading edge of the sheet and feeds the sheet toward the transfer unit 24. The toner image on the photosensitive drum 20 is electrostatically transferred to the sheet P by the transfer unit 24 and fixed to the sheet P by the fixing unit 27. The sheet P is then fed via a U-shaped feeding path and discharged to the stacker 34 by the discharge roller pair 33.

Residual toner, which remains on the photosensitive drum 20 after the image has been transferred, passes through the scorotron charger 21 and the LED optical system 22. When the residual toner reaches the developing unit 23, it is collected by the developing roller 28 concurrently with the next developing process. The accumulated toner is reused by the developing unit 23.

This apparatus is very compact. Excluding the sheet cassette 30, its width is 305 mm; with the sheet cassette 30 attached, its width is still only 445 mm. As the height of the apparatus is only 100 mm, such a printer is well suited for personal, desktop use. Even a cleaner-less process is used, as both the primary charger 21 and the transfer unit 24 employ non-contact dischargers, toner on the photosensitive drum 20 does not adhere to these units and uniform charging and image transferring can consistently be performed.

The adhered material removing mechanism will now be described. In FIG. 5A, a side view of the adhered material removing mechanism in FIG. 3, the scraping unit 25 is not in contact with the photosensitive drum 20. In the side view in FIG. 5B, the scraping unit 25 is in contact with the photosensitive drum 20.

In FIG. 5A, when the rubber blade 25-1, which is pressed against the photosensitive drum 20, scrapes a foreign substance (adhered chemical compound) from the photosensitive drum 20, the retainer 25-2 stores the foreign substance that the rubber blade 25-1 has removed. An engagement shaft 25-3 extends beyond both sides of the retainer 25-2 and is engaged by a drive mechanism that will be described later. A spring 25-4, which is provided between the engagement shaft 25-3 and a base 53, pulls the scraping unit 25 toward the base 53.

The drive mechanism 26 includes a drive motor 26-3, which will be explained while referring to FIG. 6; a drive cam 26-1; and a rotary shaft 26-2 for the drive cam 26-1. The drive cam 26-1, which rotates in unison with the rotary shaft 26-2, engages and drives the engagement shaft 25-3 to press the scraping unit 25 against the photosensitive drum 20.

When the drive cam 26-1 is at rest, as shown in FIG. 5A, the rubber blade 25-1 of the scraping unit 25 is in the position, away from the photosensitive drum 20, to which it is retracted by return force of the spring 25-4.

Figure 5B:
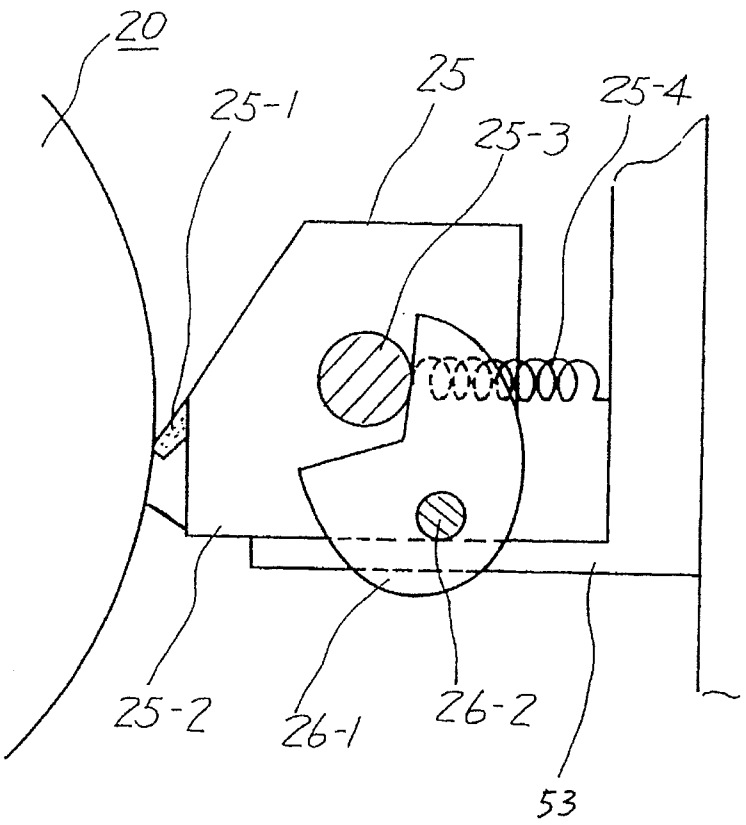
FIGS. 5A and 5B are explanatory diagrams showing the adhered material removing mechanism in FIG. 4.
Figure 5A:
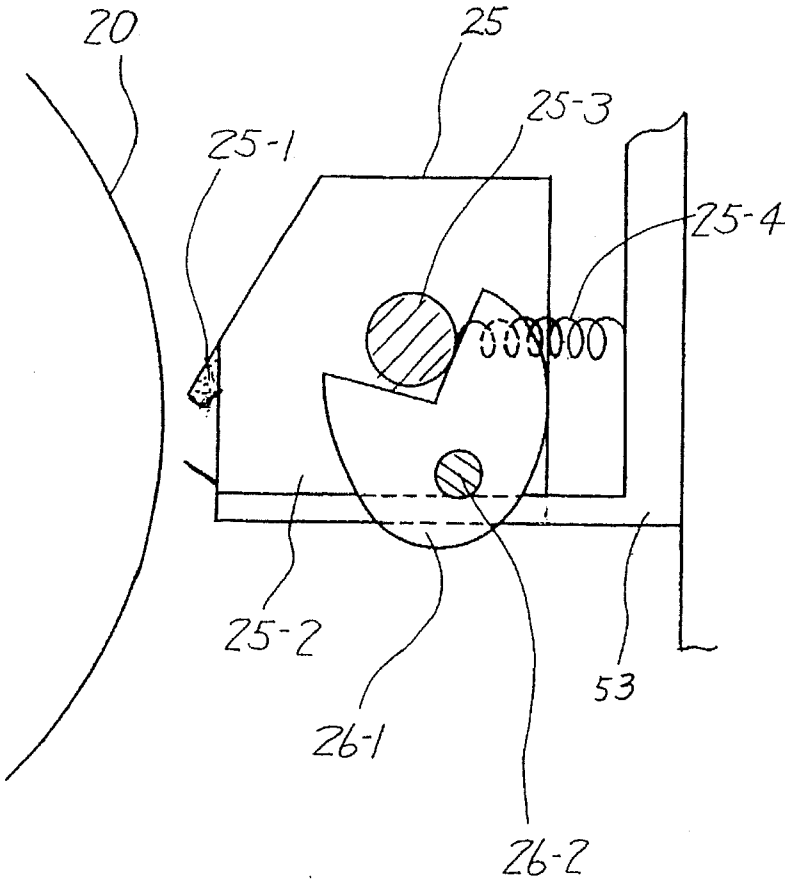

To scrape a foreign substance from the photosensitive drum 20, as shown in FIG. 5B, first the rotary shaft 26-2 is turned by the drive motor 26-3 to rotate the drive cam 26-1. The drive cam 26-1 then drives the engagement shaft 25-3 until the rubber blade 25-1 of the scraping unit 25 is pressed against the photosensitive drum 20. The rubber blade 25-1 is thus positioned to scrape adhered material from the photosensitive drum 20 as it rotates. The adhered material that is removed falls into and remains in the retainer 25-2. When the drive cam 26-1 is released, the rubber blade 25-1 of the scraping unit 25 is retracted from the photosensitive drum 20 by the spring 25-4, as shown in FIG. 5A.

The control of the adhered material removing mechanism will now be explained. FIG. 6 is a control block diagram and FIG. 7 is a flowchart of the processing performed during an adhered material removal mode.

Figure 6:
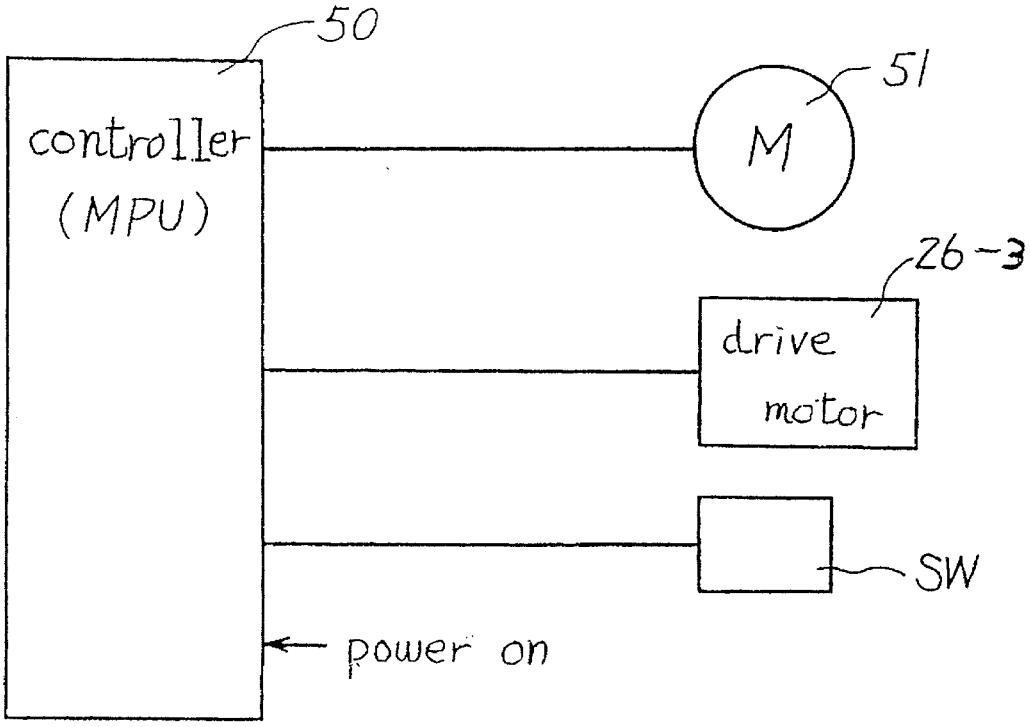
FIG. 6 is a block diagram illustrating the embodiment according to the present invention.
Figure 7:
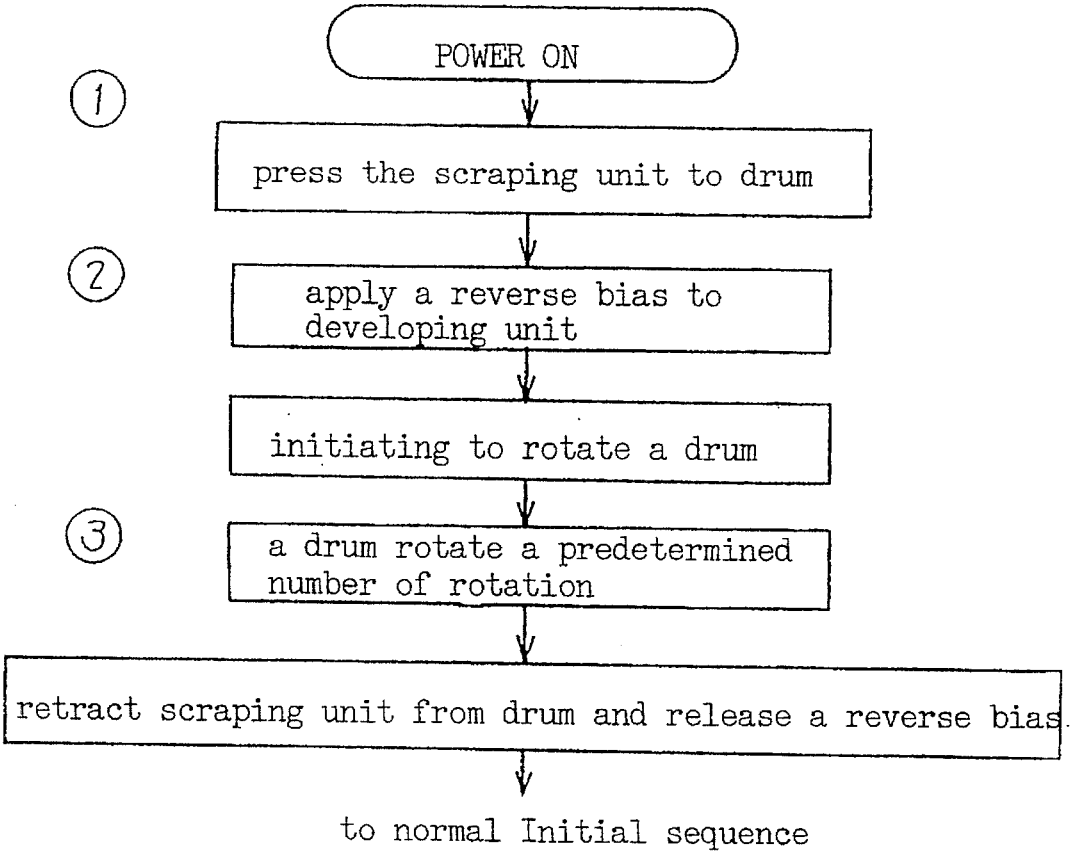
FIG. 7 is a flowchart of the process that is executed when an adhered material is removed according to the embodiment of the present invention.

In FIG. 6, a controller 50, a microprocessor (MPU), controls the individual units of the apparatus that form images. A drum motor 51 rotates the photosensitive drum 20, and the rotatable components of the developing unit 23 and the fixing unit 27. Reference numeral 26-3 denotes the previously described drive motor; symbol SW denotes a switch shown in FIG. 4.

The process for removing adhered material from the photosensitive drums 20 i(adhered material removal mode) will now be explained while referring to FIG. 7.

(1) At power on, the controller (hereafter referred to as "the processor") 50 initiates the adhered material removal process. The processor 50 first activates the drive motor 26-3, which in turn rotates the rotary shaft 26-2. As shown in FIG. 5B, the drive cam 26-1 is rotated in unison with the rotary shaft 26-2 and drives the scraping unit 25 toward the photosensitive drum 20 until its rubber blade 25-1 is pressed against the photosensitive drum 20.

(2) Next, the processor 50 activates the drum motor 51 to rotate the photosensitive drum 20. The rotatable components of the developing unit 23 and the fixing unit 27 also rotate at this time. As a result, material that has adhered to the photosensitive drum 20 is detached by the rubber blade 25-1 and collected in the retainer 25-2. In this process, the desired pressure exerted by the rubber blade 25-1 is 20 to 24 g·cm.

The processor 50 also manipulates the switch SW shown in FIG. 4 so that the reverse bias voltage power supply Vr can apply a positive reverse bias voltage to the developing roller 28. By the application of the reverse bias voltage to the developing roller 28, the efficiency of the process for collecting negatively charged residual toner from the photosensitive drum 20 is increased.

(3) When the photosensitive drum 20 has performed a predetermined number of revolutions (for example, two or more), the processor 50 temporarily halts the drum motor 51 and stops the photosensitive drum 20. At this time, the processor 50 also stopsite drive the drive motor 26-3 and the scraping unit 25 is retracted from the photosensitive drum 20 by the spring 25-4. Further, the processor 50 manipulates the switch SW to break the circuit connection to the reverse bias voltage power supply Vr, and to close the circuit connection to the positive bias voltage power supply Vb. Then the processor 50 returns to the normal initial sequence.

As is well known, the primary purpose of the initial sequence is the maintenance of high temperature in the fixing unit 27. During the initial sequence, therefore, when the drum motor 51 is activated to rotate the photosensitive drum 20, and the rotatable components of the developing unit 23 and the fixing unit 27, a current is provided to the halogen lamp 27-2 of the fixing unit 27. After the processor 50 has executed the initial sequence for a predetermined time, it waits for a printing command.

In response to a printing command, the processor 50 executes a well known image forming process (mode). More specifically, the processor 50 activates the drum motor 51 to rotate the photosensitive drum 20, and the rotatable components of the developing unit 23 and the fixing unit 27. In addition, the processor 50 permits a current to flow to the halogen lamp 27-2 of the fixing unit 27 and to drive the charger 21 and the transfer unit 24, and also permits the LED optical system 22 to expose the photosensitive drum 20 to light.

As is described above, when the photosensitive drum 20 is halted a given time or longer, the residual toner and paper fragments on the photosensitive drum 20 chemically react with ozone, nitrogen, etc. to produce chemical compounds. When there are chemical compounds adhering to the photosensitive drums 20, before the normal initial sequence is begun, the photosensitive drum is driven and the scraping unit 25 is pressed against and scrapes the photosensitive drum 20 to remove the chemical compounds and prevent the adverse effects that may arise from their presence.

Since abrasion, even through slight, of the photosensitive drum 20 occurs during the scraping process, the operation time for the scraping unit 25 should be minimized, but it should still be long enough for the photosensitive drum 20 to make at least one full revolution. The scraping process should be performed, for example, only during two revolutions of the photosensitive drum 20, so that the service life of the photosensitive drum 20 is shortened as little as possible.

Also, since a reverse bias voltage is applied to the developing unit 23 to remove residual toner from the photosensitive drum 20, removal of chemical compounds and collection of residual toner can be performed at the same time.

Besides the above described embodiment, the present invention can be modified as follows. First, in the previous embodiment an abutting member has been described as being a scraping mechanism other than a diffusion brush, but a diffusion brush can also be used as a scraping member.

In this case, a mechanism for driving the diffusion brush is provided, and by drastically varying the force with which the diffusion brush contacts the photosensitive drum 20, either the removal of adhered material or the diffusion of residual toner can selectively be performed. Second, besides a scraping mechanism, a diffusion brush and a deelectrification lamp may be provided for a cleaner-less process. Third, although the initiation of the scraping operation has been described as occurring at power on, the scraping operation may be performed when the power remains on and the photosensitive drum 20 has been halted for a predetermined time (for example, ten hours). Fourth, although an LED optical system has been specified for employment as an image exposing unit, a laser optical system, a liquid shutter optical system, an EL (Electroluminescence) optical system, or other optical system may be used instead. Fifth, although the developing unit that has been described uses a two-component magnetic developing method, other well known methods, such as a two-component, non-magnetic developing method, a magnetic toner developing method, or one-component, non-magnetic developing method, may be employed. Sixth, although an electrophotographic mechanism has been specified for employment as a latent image forming mechanism, another latent image forming mechanism that transfers a toner image (for example, an electrostatic recording mechanism) can be employed, and although plain paper has been specified for employment as a sheet P, mediums other than plain paper may be used. Seventh, although in the explanation of the previous embodiment a printer was used as an example image forming apparatus, the present invention can be employed for other image forming apparatuses, such as copy machines and facsimile machines. Eighth, even though in the bias control for the developing unit 23 a bias voltage is returned to positive after the adhered material removal processing is completed, a reverse bias voltage may be employed even while the initial sequence is being executed.

As described above, according to the present invention, since an adhered material removal mechanism is provided for a cleaner-less process, and since, after the rotation of a latent image carrier is resumed, adhered material is removed from the latent image carrier while it is in motion, it is possible to prevent the deterioration of print quality that may result from the adherence of material to a photosensitive drum. Also, as the adhered material removing operation is halted after the material has been removed, the abrasive friction to which the latent image carrier is subjected during the adhered material removal process is minimized.

What is claimed is:

1. An image forming apparatus comprising:

an endless latent image carrier;

a charging unit for charging said latent image carrier;

an image forming unit for forming a latent image on the latent image carrier;

a developing unit for developing the latent image on said latent image carrier by toner and for collecting residual toner on said latent image carrier;

a transfer unit for transferring to a sheet a toner image on said latent image carrier;

an adhered material removing mechanism for removing material that adheres to said latent image carrier;

a drive mechanism for rotating said latent image carrier; and a controller for selectively executing an image forming mode, to control said individual constituent units, and an adhered material removal mode, to permit said adhered material removing mechanism to remove said material that adheres to said latent carrier as said latent image carrier is rotated by said drive mechanism;

wherein said adhered material removing mechanism includes a diffusing member, which contacts said latent image carrier to spread residual toner on said latent image carrier, and a drive member, which is controlled by said controller to increase contact pressure of said diffusing member against said latent image carrier.

2. An image forming apparatus comprising:

an endless latent image carrier;

a charging unit for charging said latent image carrier;

an image forming unit for forming a latent image on the latent image carrier;

a developing unit for developing the latent image on said latent image carrier by toner and for collecting residual toner on said latent image carrier;

a transfer unit for transferring to a sheet a toner image on said latent image carrier;

an adhered material removing mechanism for removing material that adheres to said latent image carrier;

a drive mechanism for rotating said latent image carrier; and a controller for .selectively executing an image forming mode, to control said individual constituent units, and an adhered material removal mode, to permit said adhered material removing mechanism to remove said material that adheres to said latent carrier as said latent image carrier is rotated by said drive mechanism;

wherein in said adhered material removal mode said controller controls said adhered material removing mechanism and also permits application of a reverse bias voltage to said developing unit.

3. An image forming apparatus comprising:

an endless latent image carrier;

a charging unit for charging said latent image carrier;

an image forming unit for forming a latent image on the latent image carrier;

a developing unit for developing the latent image on said latent image carrier by toner and for collecting residual toner on said latent image carrier;

a transfer unit for transferring to a sheet a toner image on said latent image carrier;

an adhered material removing mechanism for removing material that adheres to said latent image carrier;

a drive mechanism for rotating said latent image carrier; and a controller for selectively executing an image forming mode, to control said individual constituent units, and an adhered material removal mode, to permit said adhered material removing mechanism to remove said material that adheres to said latent carrier as said latent image carrier is rotated by said drive mechanism;

wherein said adhered material removing mechanism includes an abutting member, which abuts on said latent image carrier to remove adhered material from said latent image carrier, and a drive member that drives and retracts said abutting member relative to said latent image carrier;

wherein in said adhered material removal mode said controller controls said adhered material removing mechanism and also permits application of a reverse bias voltage to said developing unit.

4. An image forming apparatus according to claim 1, wherein said controller executes said adhered material removal mode at power on.

5. An image forming apparatus according to claim 1, wherein in said adhered material removal mode said controller controls said adhered material removing mechanism and also permits application of a reverse bias voltage to said developing unit.

6. An image forming method comprising the steps of:

a rotation start step, for initiating rotation of an endless latent image carrier;

an adhered material removal step, for permitting an adhered material removing mechanism to remove material that adheres to said latent image carrier during at least one rotation of said latent image carrier following the initiation of the rotation;

a charging step, for applying an electrical charge to said rotating latent image carrier;

a latent image forming step, for forming a latent image on said rotating latent image carrier;

a developing step, for developing said latent image on said rotating latent image carrier by toner and for collecting residual toner from said rotating latent image carrier; and a transfer step, for transferring to a sheet a toner image on said rotating image carrier;

wherein at said adhered material removal step, contact pressure of a diffusing member which contacts said latent image carrier is increased to remove residual toner on said latent image carrier, and said contact pressure of said diffusing member is returned to the original value after said removal of said adhered material is completed.

7. An image forming method comprising the steps of:

a rotation start step, for initiating rotation of an endless latent image carrier;

an adhered material removal step, for permitting an adhered material removing mechanism to remove material that adheres to said latent image carrier during at least one rotation of said latent image carrier following the initiation of the rotation;

a charging step, for applying an electrical charge to said rotating latent image carrier;

a latent image forming step, for forming a latent image on said rotating latent image carrier;

a developing step, for developing said latent image on said rotating latent image carrier by toner and for collecting residual toner from said rotating latent image carrier; and a transfer step, for transferring to a sheet a toner image on said rotating image carrier;

wherein said adhered material removal step includes a step whereat a reverse bias voltage is applied to a developing unit which performs said developing step and whereat a positive bias voltage is subsequently applied to said developing unit.

8. An image forming method comprising the steps of:

a rotation start step, for initiating rotation of an endless latent image carrier;

an adhered material removal step, for permitting an adhered material removing mechanism to remove material that adheres to said latent image carrier during at least one rotation of said latent image carrier following the initiation of the rotation;

a charging step, for applying an electrical charge to said rotating latent image carrier;

a latent image forming step, for forming a latent image on said rotating latent image carrier;

a developing step, for developing said latent image on said rotating latent image carrier by toner and for collecting residual toner from said rotating latent image carrier; and a transfer step, for transferring to a sheet a toner image on said rotating image carrier;

wherein at said adhered material removal step, an abutting member abuts on said latent image carrier to remove adhered material from said latent image carrier, and is retracted from said latent image carrier;

wherein said adhered material removal step includes a step whereat a reverse bias voltage is applied to a developing unit which performs said developing step and whereat a positive bias voltage is subsequently applied to said developing unit.

9. An image forming method according to claim 6, wherein said rotation start step is executed at power on.

10. An image forming method according to claim 6, wherein said adhered material removal step includes a step whereat a reverse bias voltage is applied to a developing unit which performs said developing step and whereat a positive bias voltage is subsequently applied to said developing unit.

11. An image forming apparatus according to claim 1, wherein said adhered material removing mechanism includes an abutting member, which abuts on said latent image carrier to remove adhered material from said latent image carrier, and a drive member that drives and retracts said abutting member relative to said latent image carrier.

12. An image forming apparatus according to claim 11, wherein said abutting member has a blade, which contacts said latent image carrier, and a retainer, which stores material removed from said latent image carrier using said blade.

13. An image forming apparatus according to claim 1, wherein said controller executes said adhered material removal mode at power on.

14. An image forming apparatus according to claim 2, wherein said adhered material removing mechanism includes an abutting member, which abuts on said latent image carrier to remove adhered material from said latent image carrier, and a drive member that drives and retracts said abutting member relative to said latent image carrier.

15. An image forming apparatus according to claim 14, wherein said abutting member has a blade, which contacts said latent image carrier, and a retainer, which stores material removed from said latent image carrier using said blade.

16. An image forming apparatus according to claim 2, wherein said controller executes said adhered material removal mode at power on.

17. An image forming apparatus according to claim 3, wherein said abutting member has a blade, which contacts said latent image carrier, and a retainer, which stores material removed from said latent image carrier using said blade.

18. An image forming apparatus according to claim 3, wherein said controller executes said adhered material removal mode at power on.

19. An image forming method according to claim 6, wherein at said adhered material removal step, an abutting member abuts on said latent image carrier to remove adhered material from said latent image carrier, and is retracted from said latent image carrier.

20. An image forming method according to claim 6, wherein said rotation start step is executed at power on.

21. An image forming method according to claim 7, wherein at said adhered material removal step, an abutting member abuts on said latent image carrier to remove adhered material from said latent image carrier, and is retracted from said latent image carrier.

22. An image forming method according to claim 7, wherein said rotation start step is executed at power on.

23. An image forming method according to claim 8, wherein at said adhered material removal step, an abutting member abuts on said latent image carrier to remove adhered material from said latent image carrier, and is retracted from said latent image carrier.

24. An image forming method according to claim 8, wherein said rotation start step is executed at power on.

* * * * *